US008075464B2

(12) United States Patent
Hayes et al.

(10) Patent No.: US 8,075,464 B2
(45) Date of Patent: Dec. 13, 2011

(54) PORTABLE ABDOMINAL EXERCISE MAT

(75) Inventors: Christopher Blake Hayes, Laguna Hills, CA (US); Nick L. Payzant, Irvine, CA (US)

(73) Assignee: Christopher Blake Hayes, Laguna Hills, CA (US)

( * ) Notice: Subject to any disclaimer, the term of this patent is extended or adjusted under 35 U.S.C. 154(b) by 0 days.

(21) Appl. No.: 12/696,894

(22) Filed: Jan. 29, 2010

(65) Prior Publication Data

US 2010/0197471 A1 Aug. 5, 2010

Related U.S. Application Data

(60) Provisional application No. 61/148,511, filed on Jan. 30, 2009.

(51) Int. Cl.
*A63B 21/00* (2006.01)

(52) U.S. Cl. ..... 482/142; 482/140; 5/122; 5/123; 5/127

(58) Field of Classification Search ..... 482/142, 482/130, 140; 5/122, 123, 127
See application file for complete search history.

(56) References Cited

U.S. PATENT DOCUMENTS

| | | | | | |
|---|---|---|---|---|---|
| 873,652 | A | * | 12/1907 | Banks | 5/122 |
| 2,096,423 | A | * | 10/1937 | Burr | 5/122 |
| 5,009,417 | A | | 4/1991 | Sarkozi | |
| 5,577,987 | A | | 11/1996 | Brown | |
| 5,697,874 | A | | 12/1997 | Abelbeck | |
| D390,288 | S | | 2/1998 | Fingleson et al. | |
| 5,720,699 | A | * | 2/1998 | Musachio et al. | 482/122 |
| 5,853,356 | A | * | 12/1998 | David | 482/126 |
| 5,971,480 | A | * | 10/1999 | Maschke | 297/273 |
| D430,627 | S | | 9/2000 | Bergman | |
| 6,322,485 | B1 | | 11/2001 | Marrero | |
| 6,663,537 | B2 | | 12/2003 | McCoy | |
| 7,172,540 | B2 | | 2/2007 | Nguyen | |

* cited by examiner

*Primary Examiner* — Jerome W Donnelly

(74) *Attorney, Agent, or Firm* — Mind Law Firm; Justin G. Sanders; Jeromye V. Sartain

(57) ABSTRACT

A portable abdominal exercise mat apparatus is disclosed comprising, in one embodiment, an elongate, flexible mat having a relatively rigid elongate handle portion engaged at one end of the mat, the apparatus being sized and configured for providing adequate support for a user's back, neck and head while the user performs a wide range of abdominal exercises. In further embodiments, the handle portion is configured for removably accepting a variety of attachment accessories, some of which are designed to allow the user to selectively add resistance to their abdominal exercises. Other attachment accessories allow the user to perform various non-abdominal exercises using the apparatus. When the apparatus is not being used, it can be easily rolled up or laid flat for storage or transport with very little space or weight requirements.

17 Claims, 9 Drawing Sheets

PORTABLE ABDOMINAL EXERCISE MAT

RELATED APPLICATIONS

This application claims priority and is entitled to the filing date of U.S. Provisional application Ser. No. 61/148,511 filed Jan. 30, 2009, and entitled "Portable Abdominal Exercise Mat." The contents of the aforementioned application are incorporated by reference herein.

INCORPORATION BY REFERENCE

Applicant(s) hereby incorporate herein by reference any and all U.S. patents and U.S. patent applications cited or referred to in this application.

BACKGROUND OF THE INVENTION

1. Field of the Invention

Aspects of this invention relate generally to a novel exercise mat, and more particularly to a portable abdominal exercise mat apparatus configured for providing adequate support for a user's back, neck and head while the user performs a wide range of abdominal exercises.

2. Description of Related Art

As is known in the art, one of the most frequently recommended exercises for strengthening and building a person's abdominal muscles is called a crunch. A crunch begins with a person lying on a stable surface, such as a floor or mat, with their knees up, feet on the floor, and hands crossed over their chest or lightly touching the back of their head. From this position, the person raises their upper torso approximately eight inches off the floor while keeping their lower back and torso in contact with the floor. Performing crunches is a simple and effective abdominal exercise, which essentially requires no equipment. However, studies have found that performing crunches over time leads to neck and lower back pain. Abdominal exercise devices have been designed to reduce these potential pains, as well as allow a user to perform abdominal exercises more precisely and efficiently. Thus, the concept of abdominal exercise devices is very well known.

The following art defines the present state of this field:

U.S. Pat. No. 5,009,417, issued on Apr. 23, 1991 to Sarkozi, discloses a portable exercise device for strengthening abdominal muscles which can be operated by an individual exercising on a mattress and box spring, or the like combination, without requiring additional assistance during the exercise routine. The device may be easily unfolded for use, and following use, it may be refolded and conveniently stored. The device at one end is folded for securement between the mattress and the box spring, and unfolds and overlays the upper portion of the mattress for use by the individual. The device is adapted to fold and conform with the user's bent ankles, knees and hips, and these folds correspond to the fold lines for folding and unfolding the device. Foot securement means are employed to stabilize the user's feet, and this eliminates the need for assistance during the exercise program. The device at the opposite end lies on the mattress and includes a sheet material upon which the user rests, and the weight of the user on the sheet anchors the device on the mattress and prevents it from slipping or becoming displaced during use.

U.S. Pat. No. 5,577,987, issued on Nov. 26, 1996 to Brown, discloses an abdominal exerciser device made of a one piece skeletal frame. The frame defines a pair of support rails, a pair of arcuate rocker portions, a pair of arm rest portions and an arch-shaped portion connecting the support rails together.

Removable cushions are disposed on the arm rest portions to receive the elbows of the user when in a supine position. The head and neck of a user are supported on a head rest which is secured to the arch-shaped portion. The rocker portions are curved on a circular arc to mimic the curvature of the spine of the user.

U.S. Pat. No. 5,697,874, issued on Dec. 16, 1997 to Abelbeck, discloses an abdominal exercise device that includes a pair of arm portions for the user to grasp, a head rest and support attached thereto, the support being attached to the arm portions, an extension portion extending from each arm portion and a curved radius on the other end thereof. The curved radius being received by a segmented track, the proximal end of the track being fixed to the extension portions such that when a person lies face up between the extension portions with their head on the head rest and pulls down on the arm portions, contracting the abdominal muscles and rolling the curved radius along the track picking up same, the abdominal muscles are worked and the instantaneous center of rotation of the articulating vertebrae are in proper alignment with the instantaneous rotation of the device. This guides the body in a proper sit up movement working the abdominal muscles while the head and neck are constantly supported by the head rest. A pelvis support can be fixed to the distal end of each of the tracks thereby offering and maintaining proper placement of the body to the machine, protecting the tail bone from injury from a hard floor and placing the pelvis in slight posterior rotation, reducing lower back stress during the movement.

U.S. Design Pat. No. D390,288, issued on Feb. 3, 1998 to Fingleson et al., discloses an ornamental design for an abdominal exercise mat.

U.S. Design Pat. No. D430,627, issued on Sep. 5, 2000 to Bergman, discloses an ornamental design for an exercise mat.

U.S. Pat. No. 6,322,485, issued on Nov. 27, 2001 to Marrero, discloses a portable abdominal exercising mat including a mat portion defined by an upper panel and a lower panel. The upper panel and the lower panel each have an inner surface, an outer surface, an upper edge, a lower edge, and opposed side edges. The lower edge of the upper panel and the upper edge of the lower panel are foldably coupled whereby the mat portion in an extended orientation has the opposed side edges of the upper and lower panels linearly aligned. The outer surface of the upper panel has a gaming board printed thereon.

U.S. Pat. No. 6,663,537, issued on Dec. 16, 2003 to McCoy, discloses a non-slip exercise mat for use on multiple surfaces including at least one layer of material having a top surface, a bottom surface, and side surfaces. The mat also includes systems for removably securing the mat to carpeted surfaces and for preventing the mat from slipping on non-carpeted surfaces. Both systems can be joined with the bottom surface or joined on opposite surfaces of the mat. The mat may include shock absorbing materials as well as texturized, slip-resistant materials. The sides of the mat may be beveled. The mat may also include a cover for the system for removably securing the mat to carpeted surfaces.

U.S. Pat. No. 7,172,540, issued on Feb. 6, 2007 to Nguyen, discloses a portable exercise device for use in abdominal strengthening and toning in conjunction with a supporting component. The supporting structure can be a bed frame and the supporting component is usually the bed frame's transverse bar. The portable exercise device can be operated while lying on the bed, and includes bonded members: a first end, a body, and a second end. The first end is designed to hook to the support structure. The second end is designed to be place on a floor and is linked by two bar members that hook the user's feet in place. The body is a bar built between the first and second ends to secure the device.

Many of the known prior art devices, while effective at targeting a user's abdominal muscles, are relatively large and expensive, and are thus primarily available only at commercial fitness centers. Smaller, less expensive personal devices have been designed to solve these problems, allowing a user to exercise in the comfort of their home or office or other such location.

Many of these prior art personal devices essentially comprise a skeletal frame having a rockered portion and a head rest, whereby the user operates the device on a stable surface, such as a floor, and the rockered portion assists the user in performing a crunch. While these personal devices typically provide a head rest, they fail to provide adequate neck and back support. Furthermore, when these devices are used on hard surfaces, a padded mat is usually required in order to exercise comfortably.

A still further disadvantage of these personal devices is that while some are sufficiently compact to be used in a relatively small area, such as the user's home or office, they still typically require a considerable amount of space when they are being stored or transported and so are not easily portable. The Fingleson et al. device attempts to solve this problem by providing an abdominal exercise mat that can presumably be rolled up when not in use. However, the Fingleson et al. device shares further disadvantages with the prior art as discussed below.

A still further disadvantage of these personal devices is that they are typically designed to only allow the user to perform a standard crunch, which primarily strengthens only the rectus abdominis muscles. Thus, the user is typically unable to easily perform other types of crunches in order to strengthen the other abdominal muscles, such as the oblique muscles.

A still further disadvantage of these personal devices is the fact that most operate solely on gravitational resistance. In other words, users are unable to selectively increase or decrease the amount of resistance applied in performing a crunch.

Thus, while the prior art described above teaches various types of abdominal exercise devices, it fails to teach a portable abdominal exercise mat that comprises a flexible mat having a relatively rigid elongate handle portion engaged at one end of the mat. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention are directed to solving these problems by providing a portable abdominal exercise mat apparatus comprising, in an exemplary embodiment, an elongate, flexible mat having a relatively rigid elongate handle portion engaged at one end of the mat, the apparatus being sized and configured for providing adequate support for a user's back, neck and head while the user performs a wide range of abdominal exercises. In one embodiment, the handle portion is configured for removably accepting a variety of attachment accessories, some of which are designed to allow the user to selectively add resistance to their abdominal exercises. Other attachment accessories allow the user to perform various non-abdominal exercises using the apparatus. When the apparatus is not being used, it can be easily rolled up or laid flat for storage or transport with very little space or weight requirements. Thus, aspects of the present invention provide a solution to the above discussed shortcomings of the prior art.

It will be appreciated by those skilled in the art that the exact configuration of the apparatus may take a number of forms to suit particular applications without departing from the spirit and scope of the present invention. Accordingly, it will be further appreciated that the configuration of the apparatus shown and described is exemplary and that the invention is not so limited.

A primary objective inherent in the above described apparatus and method of use is to provide advantages not taught by the prior art.

Another objective is to provide such an apparatus that is configured for assisting and supporting a user's back, neck and head while the user performs a wide range of abdominal exercises.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
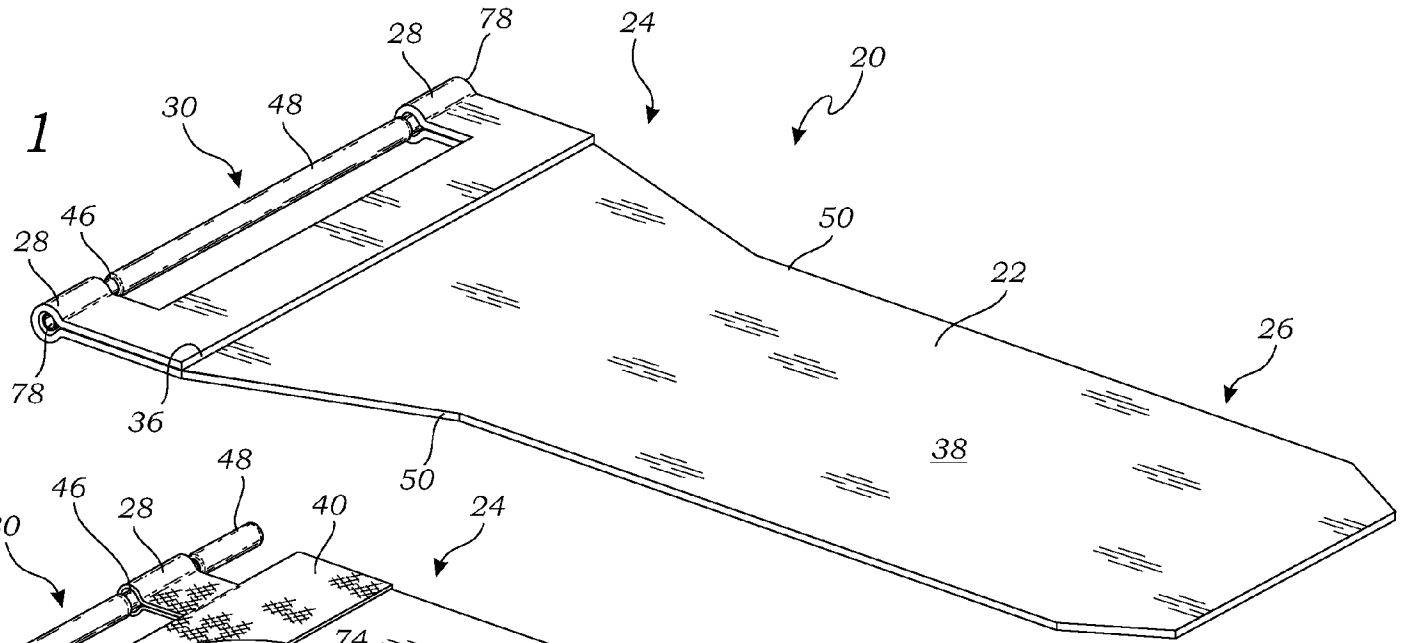
FIG. 1 is a perspective view of an exemplary embodiment of the present invention.

Turning now to FIG. 1, there is shown a perspective view of an exemplary embodiment of a portable abdominal exercise mat apparatus 20. The apparatus 20 comprises, in one embodiment, an elongate flexible mat 22 terminating proximally in a first end 24 and distally in a second end 26. Preferably the mat 22 is made of a soft, flexible yet resilient material, such as foam or other thermoplastic elastomer. Such materials are already known and used in other types of exercise mats, such as yoga mats. It should be noted, however, that other materials now known or later developed may be used as well.

The first end 24 provides an at least one loop 28 sized and configured for receiving an elongate handle portion 30. In one embodiment, shown best in FIGS. 1, 2 and 4, the first end 24 provides a pair of spaced apart loops 28. In an alternate embodiment, shown best in FIG. 3, the first end 24 provides a single loop 28. Preferably, the handle portion 30 is slidably engaged within the loops 28. In an alternate embodiment, the handle portion 30 is permanently secured within the loops 28. The loops 28 are configured such that the handle portion 30 is partially spaced apart from the first end 24, thereby allowing a user 32 to grasp the handle portion 30 with one or both of their hands 34.

Figure 2:
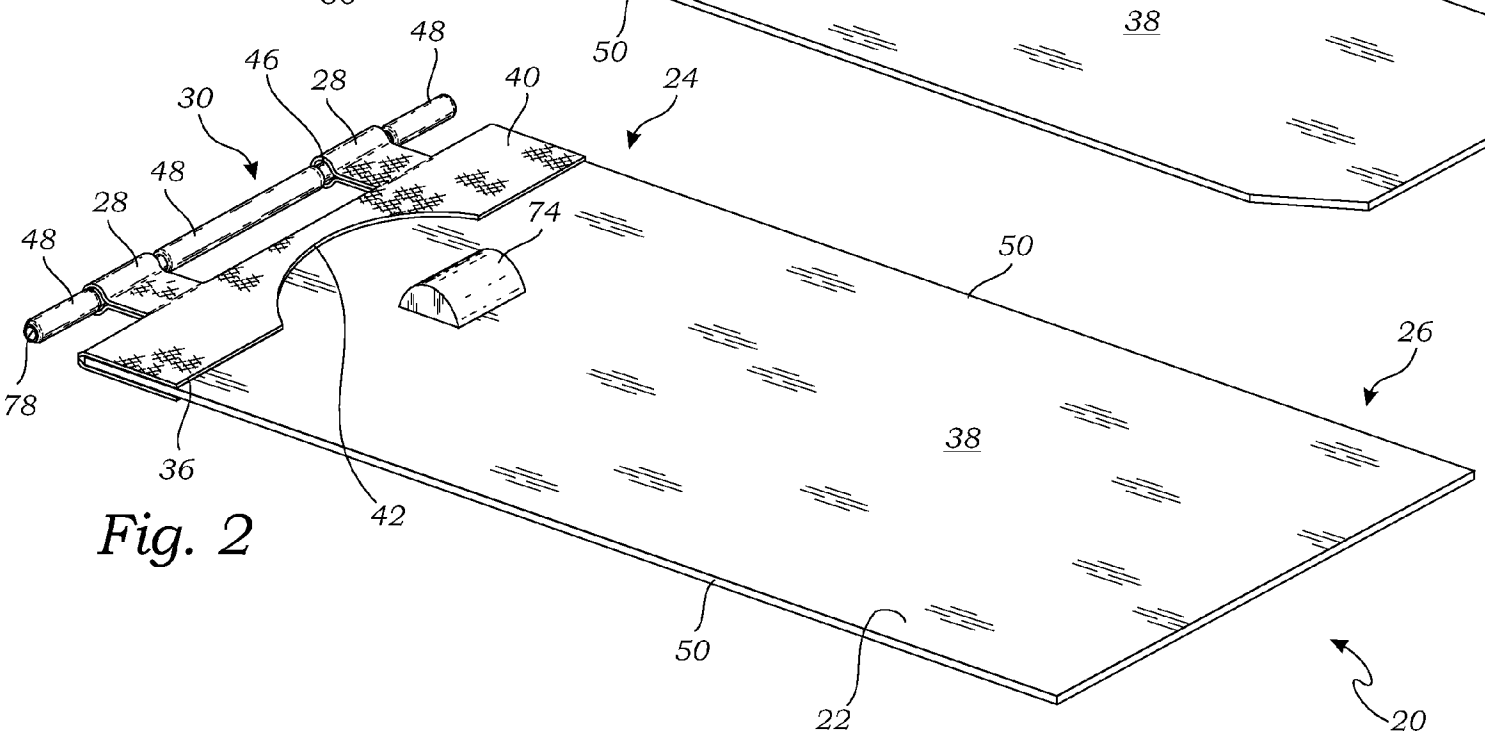
FIG. 2 is a perspective view of an alternate embodiment of the present invention.
Figures 3, 4:
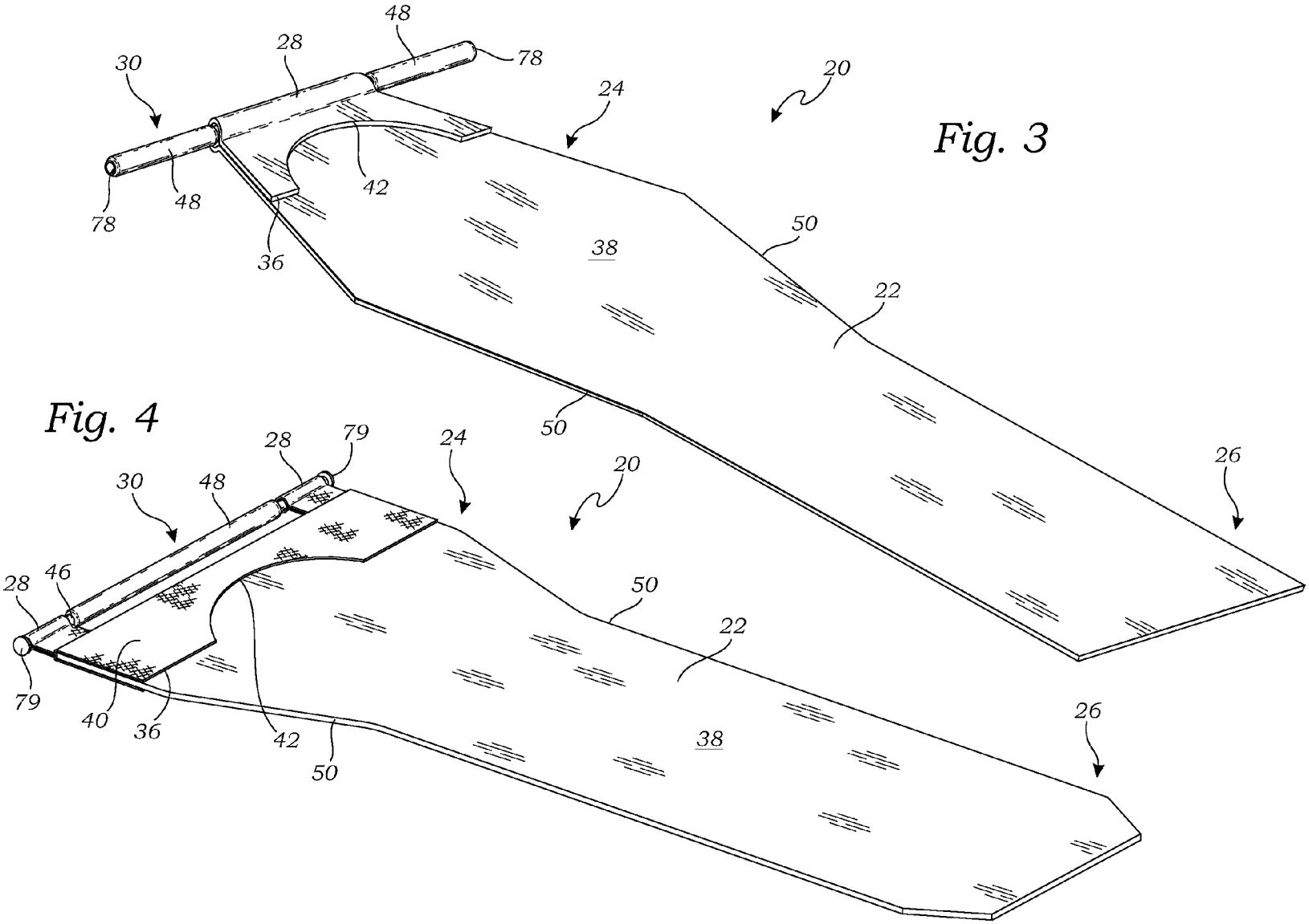
FIG. 3 is a perspective view of a further alternate embodiment of the present invention.
FIG. 4 is a perspective view of a still further alternate embodiment of the present invention.

In one embodiment, as shown in FIGS. 1 and 3, the loops 28 are made of the same material as the mat 22 and formed by folding a portion of the first end 24 against itself and permanently securing it in place using stitching, adhesives, sonic or RF welding, or any other means now known or later developed and appropriate for the materials being joined. With the first end 24 folded against itself, a seam 36 is formed on a top surface 38 of the mat 22. In another embodiment, as shown in FIGS. 2 and 4, the loops 28 are made of a durable material, such as nylon webbing 40, separate from the mat 22, enabling the apparatus 20 to be capable of withstanding a relatively high degree of tension force when the apparatus 20 is in use. The nylon webbing 40 is permanently secured to the first end 24 again using stitching, adhesives, welding, or any other suitable means now known or later developed. Similar to the embodiment described above, a seam 36 is formed on the top surface 38 of the mat 22 between the nylon webbing 40 and the mat 22. In a further embodiment, as best shown in FIGS. 2, 3 and 4, a portion of the seam 36 defines an arch 42, which serves as a positioning reference point for the user 32 to know where to place their head 44 on the mat 22 during use of the apparatus 20. In still further embodiments, the handle portion 30 may be engaged with the first end 24 of the mat 22, either removably or permanently, using any means now known or later developed.

The handle portion 30 preferably comprises a relatively rigid elongate rod 46 and a padded grip portion 48 engaged with a section of the rod 46, as best shown in FIGS. 1-4. The rod 46 is preferably made of metal, plastic, or some other relatively rigid, durable material now known or later developed. The grip portion 48 is preferably made of a relatively soft, non-slip material such as foam or rubber. However, other materials now known or later developed may be used as well.

The mat 22 further has a pair of opposing lateral edges 50. In the exemplary embodiment, as shown in FIGS. 1 and 4, the lateral edges 50 are tapered along at least a portion thereof; thus, the first end 24 of the mat 22 is wider than the second end 26 in order to accommodate or mimic the dimensions of the average human body, i.e., wider shoulders and narrower waist. By way of example, in one embodiment, the first end 24 measures twenty four inches (24") wide and tapers down to eighteen inches (18") wide at the second end 26. In another embodiment, as shown in FIG. 2, the mat 22 is rectangular in shape and has a uniform width. In a still further embodiment, as shown in FIG. 3, the first end 24 of the mat 22 is substantially diamond-shaped in order to accommodate the dimensions of the upper half of the average human body, i.e., narrower head, wider shoulders, and narrower waist. In the preferred embodiment, the length of the mat 22 is approximately sixty eight inches (68") in order to accommodate a wide range of users 32. It should be noted that the above described dimensions and geometries are merely intended to illustrate exemplary embodiments, and should in no way be interpreted as limiting the present invention in any way. Furthermore, though not required, in a preferred embodiment the length of the handle portion 30 is substantially the same as or greater than the width of the first end 24 or is at least as long as the distance between the opposing lateral edges 50 of the mat at the first end 24, such that the handle portion 30 is substantially parallel to and extends the length of the first end 24.

Figure 5:
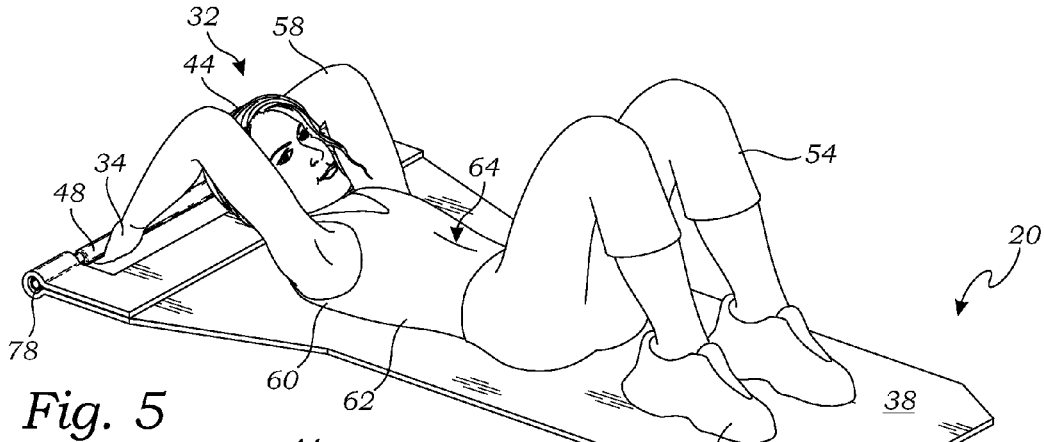
FIGS. 5-7 are perspective views of one embodiment of the present invention in use.
Figure 6:
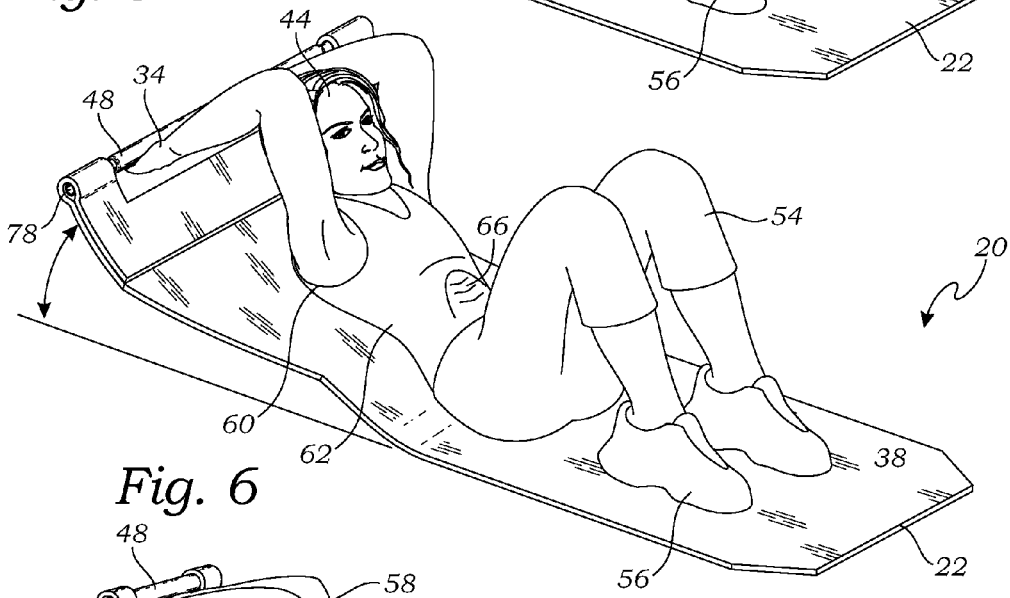
Figure 7:
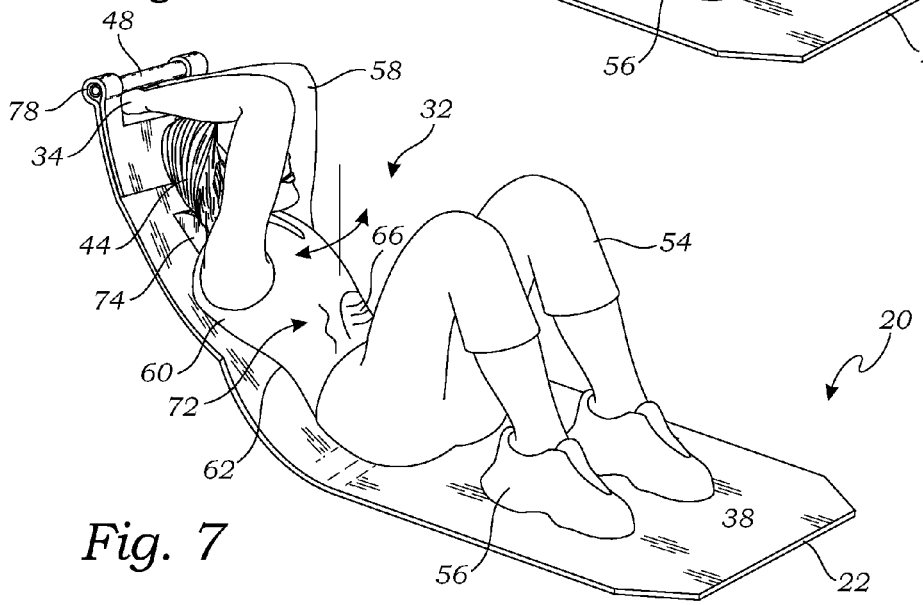
Figure 8:
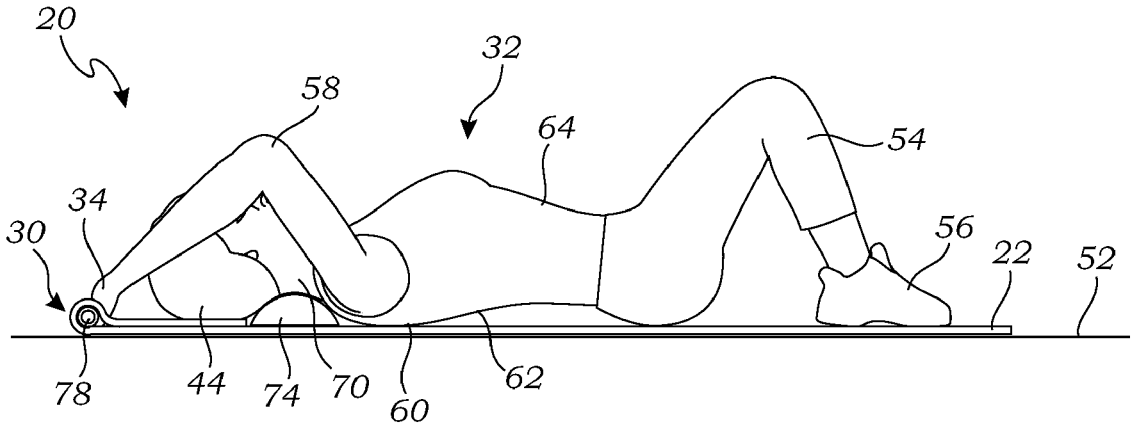
FIGS. 8 and 9 are side elevational views of one embodiment of the present invention in use.
Figure 9:
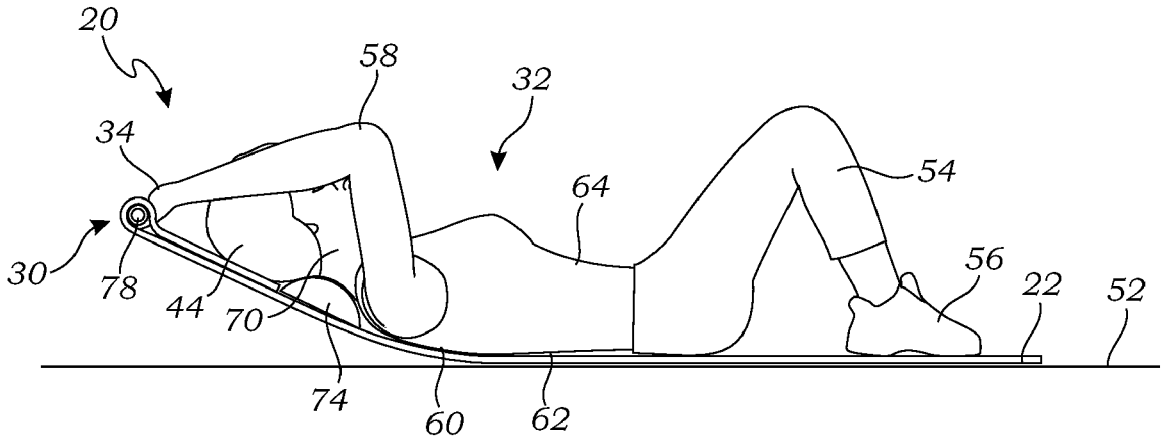

FIGS. 5-9 illustrate exemplary uses of the present invention. As shown in FIGS. 5 and 8, with the apparatus 20 positioned on a stable surface, such as a floor 52, the user 32 begins by lying on the top surface 38 of the mat 22 with their legs 54 bent, and their feet 56 in flat contact with the top surface 38. Alternately, not shown in the drawings, the user 32 may bend their legs 54 such that their feet 56 are elevated above the top surface 38. Referring still to FIGS. 5 and 8, the user 32 then places their hands 34 above their head 44, grasping the handle portion 30 with their elbows 58 slightly bent. Referring now to FIGS. 6 and 9, the user 32 then pushes the handle portion 30 upward while lifting their shoulder blades 60 off the floor 52 and moving their elbows 58 toward their legs 54. As clearly illustrated in FIG. 9, given the flexible qualities of the mat 22, the top surface 38 of the mat 20 conforms to the user 32 as the mat 22 lifts off the floor 52 along with the user 32. Thus, the top surface 38 remains in substantially continuous contact with the user's back 62 and head 44, thereby providing the support necessary to perform a proper crunch exercise and allowing the user 32 to focus on using only their abdominal muscles 64, not the muscles in their back 62 and neck 70. In performing the crunch exercise illustrated in FIGS. 5 and 6, the user 32 is able to primarily strengthen the user's rectus abdominis muscles 66.

To strengthen other sections of abdominal muscles 64, the user 32 may perform other types of crunches using the apparatus 20. For example, as shown in FIG. 7, to strengthen the user's oblique muscles 68, the user 32 may perform oblique crunches by pushing the handle portion 30 upward, lifting their shoulder blades 60 off the floor 52, and rotating their torso 72 left or right. Again, due to the flexible qualities of the mat 22, the top surface 38 conforms to the user 32 and remains in substantially continuous contact with the user's back 62 and head 44, thereby providing the necessary support even when twisting out of plane or bending off-axis, allowing the user 32 to safely and effectively focus on using only their abdominal muscles 64 even when performing such side crunches.

In one embodiment, shown in FIG. 2, the apparatus 20 further provides a neck rest 74 configured for supporting the user's neck 70 during use of the apparatus 20. The neck rest 74 is preferably made of a soft, conforming material, such as foam. However, other soft materials now known or later developed may be used as well. Preferably, the neck rest 74 is selectively and non-permanently positionable on the top surface 38 of the mat 22, allowing users 32 of varying heights to create a customized arrangement in order to maximize the comfort and effectiveness of the apparatus 20. In one embodiment, the neck rest 74 is held in place on the top surface 38 solely by friction, as the neck rest 74 is sandwiched between the top surface 38 and the user's neck 70 during use of the apparatus 20, as shown best in FIGS. 8 and 9. In alternate embodiments, the neck rest 74 may be removably or permanently secured to the top surface 38 using hook and loop fasteners, stitching, adhesives, or any other means now known or later developed. Thus, when the neck rest 74 is used, the apparatus 20 is capable of providing adequate support not only to the user's back 62 and head 44, but their neck 70 as well.

Figure 12:
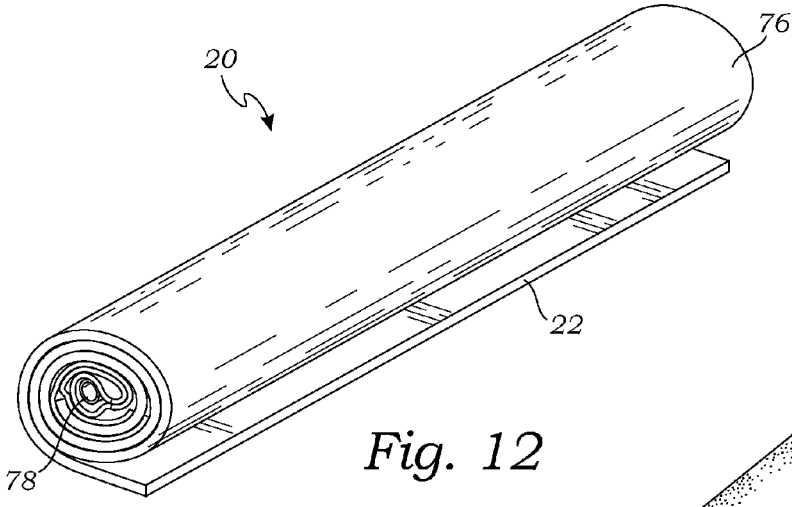
FIG. 12 is a perspective view of an exemplary embodiment of the present invention in a rolled position for when the invention is not in use.

As shown in FIG. 12, when the apparatus 20 is not in use, it can be rolled up into a compact roll 76 measuring approximately four to five inches (4"-5") in diameter. This allows the apparatus 20 to be easily stored or transported with very little space or weight requirements. Alternately, because the apparatus 20 is relatively thin when it is unrolled, it can be stored in relatively narrow horizontal spaces, such as underneath a bed, or even in relatively narrow vertical spaces, such as being hung in a closet, on a wall, or behind a door, for example.

Figure 10:
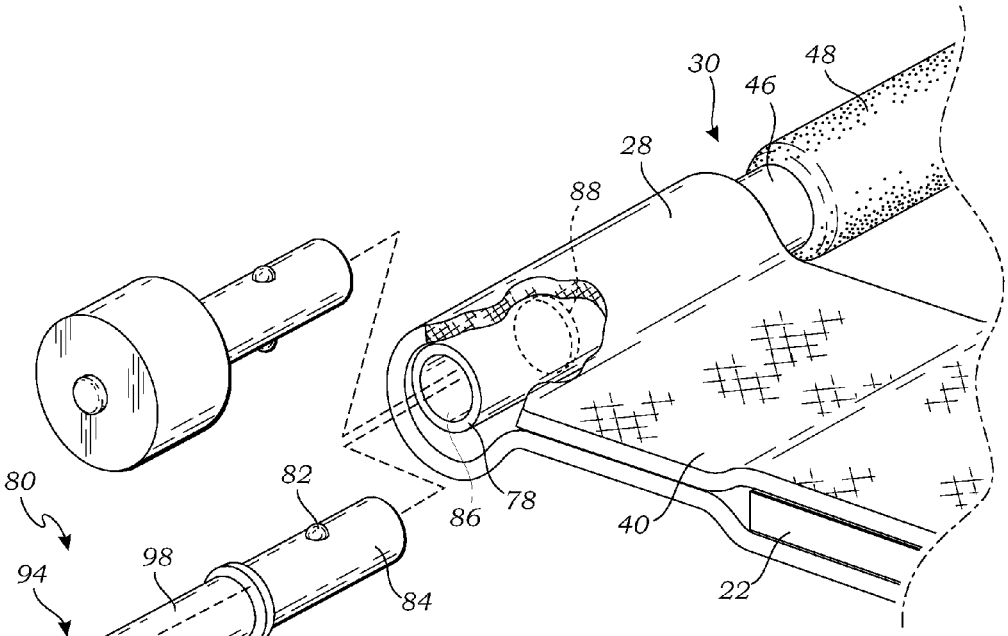
FIGS. 10 and 11 are partial perspective views of further embodiments of the present invention having selectively engagable weight attachments.

In the exemplary embodiment, as best shown in FIGS. 1-3, the handle portion 30 has a pair of opposing handle ends 78 configured for removably accepting a variety of attachment accessories 80. In an alternate embodiment, where no attachment accessories 80 are utilized, the handle ends 78 may optionally provide a pair of end caps 79, as shown in FIG. 4. Referring now to FIG. 10, each one of the attachment accessories 80 preferably provides a means for removable engagement with the handle ends 78. In one embodiment, the means for removable engagement is an at least one retractable pin 82 protruding through an elongate shaft portion 84 of the attachment accessory 80. The handle ends 78 are sized and configured for coaxially receiving the shaft portion 84, an inner surface 86 of each one of the handle ends 78 providing an annular groove 88 sized for receiving the at least one pin 82. Each one of the attachment accessories 80 further provides a release button 90 which is mechanically interconnected with the at least one pin 82. Thus, when the release button 90 is pressed, the at least one pin 82 disengages the annular groove 88 and retracts into the shaft portion 84, allowing the attachment accessory 80 to be removed from the handle end 78. It should be noted that the above-described means for removable engagement is merely intended to be one example of such means, and any other means for removable engagement between the handle ends 78 and attachment accessories 80, now known or later developed, may be substituted, such as an interference or press fit, a twist-lock pin and channel engagement, a threaded connection, or a cross-pin connection, for example.

Figure 11:
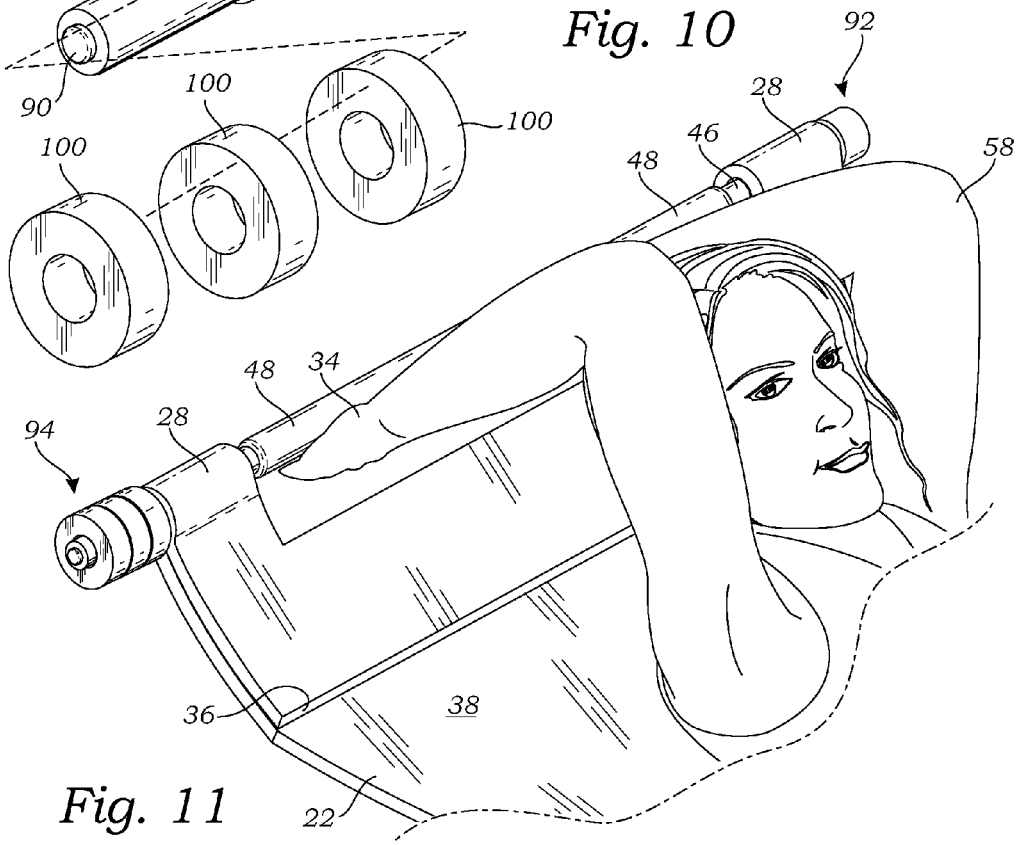

FIGS. 10 and 11 illustrate two types of attachment accessories 80: an integral weight attachment 92 and a selective weight attachment 94. Both the integral and selective weight attachments 92 and 94 are configured to add a desired amount of weight to the handle portion 30. Thus, when the user 32 performs abdominal exercises similar to those described above, and shown in FIG. 11, the weight creates added resistance, thereby allowing the user 32 to further strengthen their abdominal muscles 64. Referring again to FIG. 10, the integral weight attachment 92 provides a pre-determined amount of weight by way of a weight portion 96 formed with the shaft portion 84 as a unitary piece. Thus, different integral weight attachments 92 provide different sized weight portions 96, allowing the user 32 to customize the amount of weight added to the handle portion 30. The selective weight attachment 94 provides an elongate bar 98 integral with the shaft portion 84 and configured for slidably receiving a plurality of disc weights 100 having varying weight amounts. Thus, the user 32 is able to selectively adjust the weight of the handle portion 30 by adding or removing disc weights 100 accordingly. Again, while particular attachment accessories 80, and an integral weight attachment 92 or a selective weight attachment 94, specifically, are shown and described, it will be appreciated by those skilled in the art that the invention is not so limited, but that other weight configurations, as well as a variety of additional accessories for increasing resistance or adding other features and functionality and possible in the present invention without departing from its spirit and scope, as will be further appreciated in view of the additional embodiments shown in FIGS. 13-17 as described below.

Figure 13:
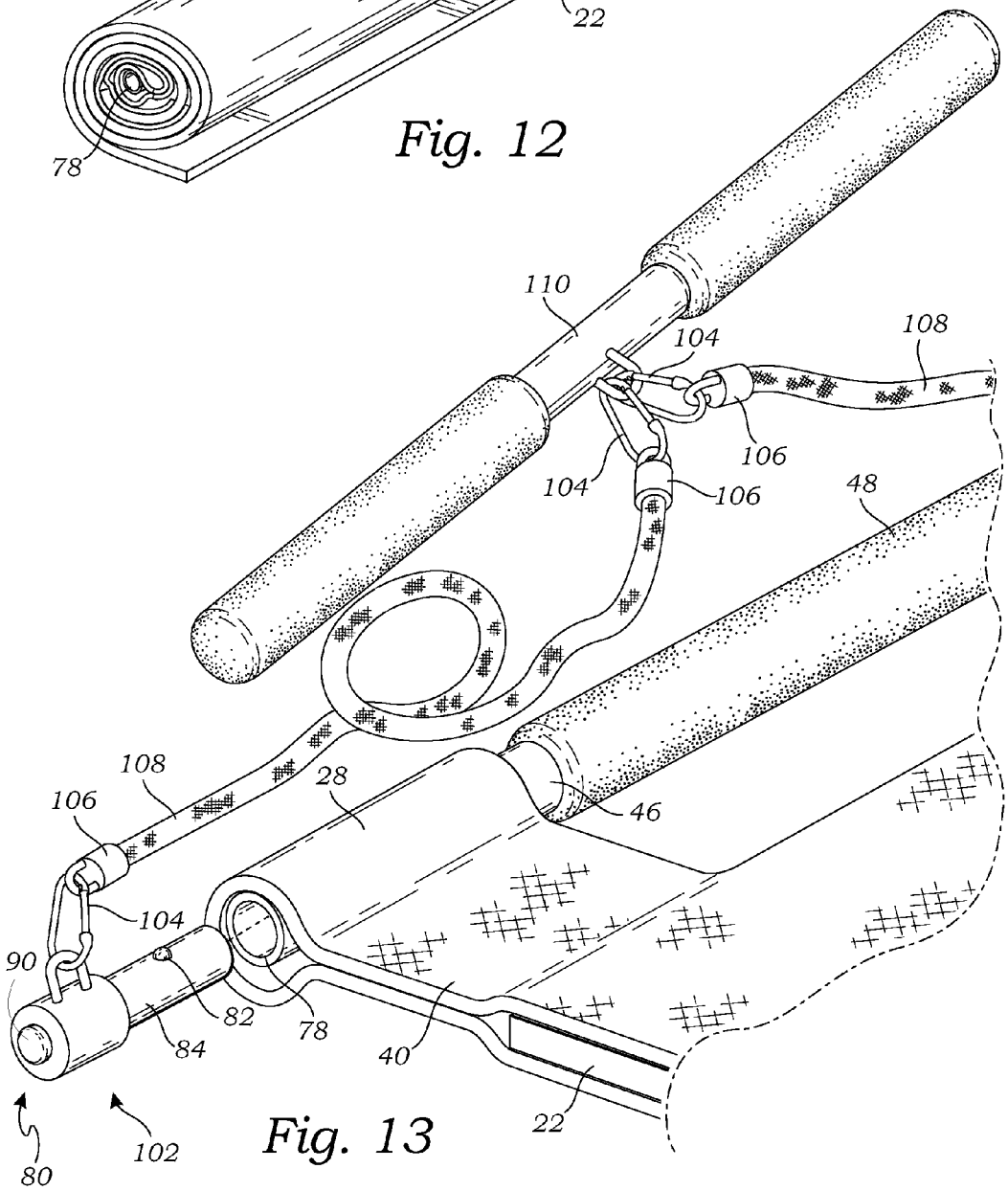
FIGS. 13 and 14 are partial perspective views of a further embodiment of the present invention having selectively engagable resistance band attachments.
Figure 14:
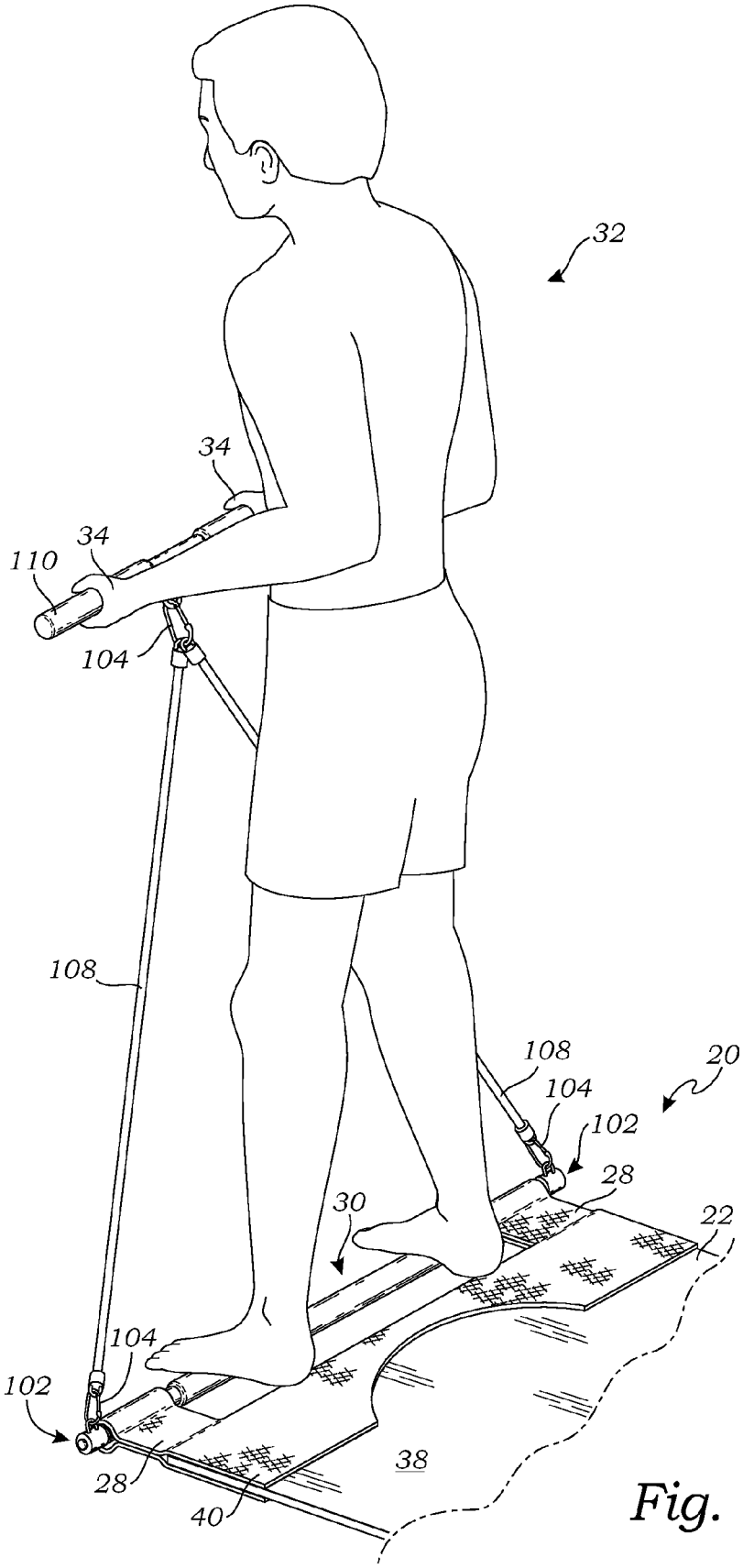

FIGS. 13 and 14 illustrate another type of attachment accessory 80: a resistance band attachment 102 configured for allowing the user 32 to perform a wide range of both abdominal as well as non-abdominal exercises. In one embodiment, the resistance band attachment 102 comprises an attachment point 104 integral with the shaft portion 84, the attachment point 104 configured for removable engagement with an end 106 of an elastic resistance band 108. The attachment point 104 may be a hook, carabiner, or any other means, now known or later developed, capable of removable engagement with a resistance band 108. In another embodiment, the end 106 of the resistance band 108 is permanently secured to the shaft portion 84. To perform various non-abdominal exercises, a second handle 110 may optionally be engaged with a pair of resistance band attachments 102, as shown in FIGS. 13 and 14. With the second handle 110 engaged, the user 32 may perform such non-abdominal exercises as bicep curls by standing on the handle portion 30 of the mat 22 and curling the second handle 110, as shown in FIG. 14.

Figure 15:
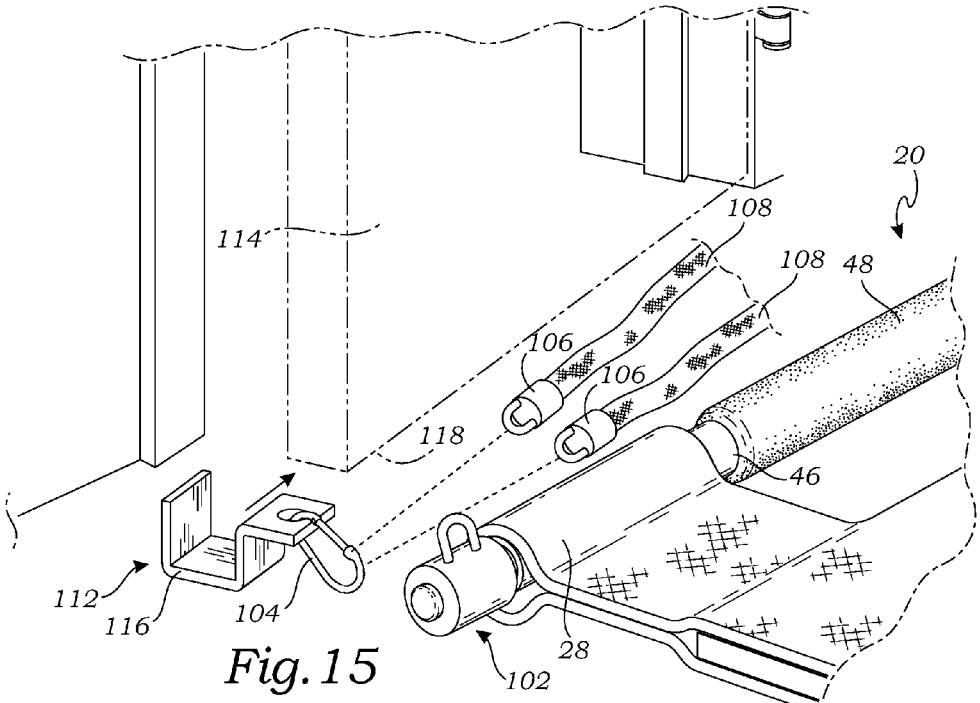
FIGS. 15-17 are partial perspective views of a further embodiment of the present invention having a selectively engagable door attachment.
Figure 16:
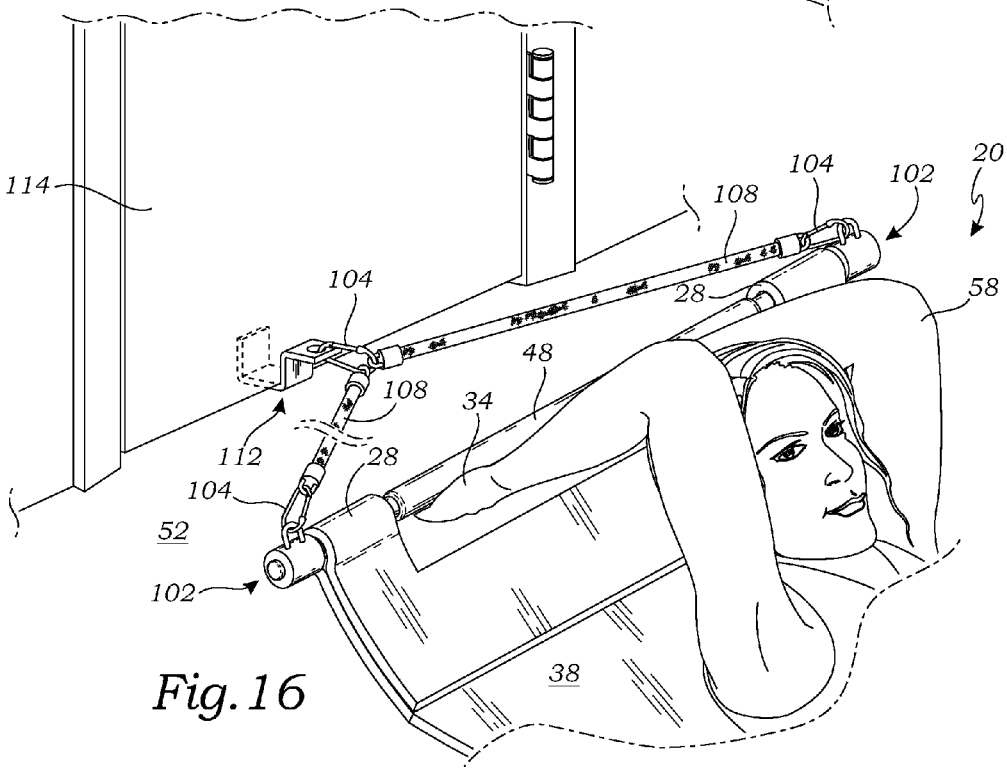
Figure 17:
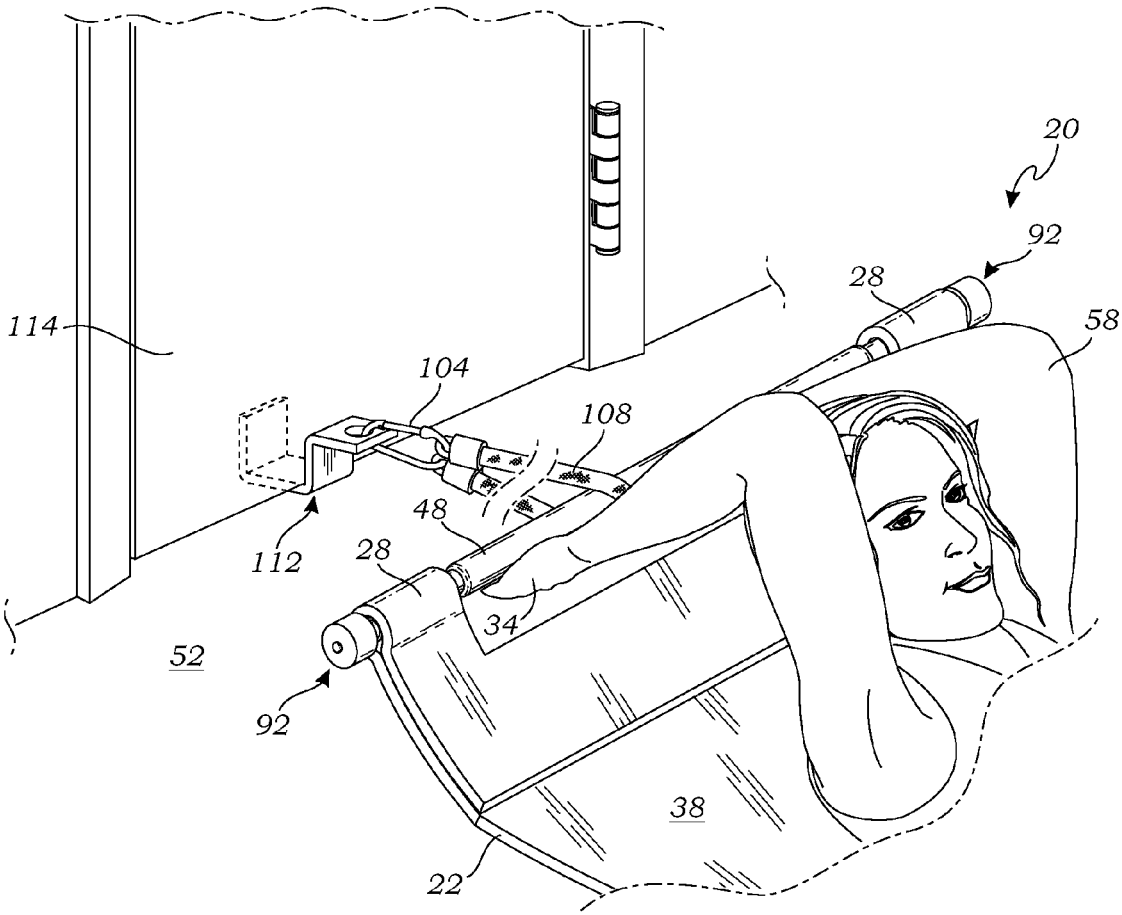

FIGS. 15-17 illustrate yet another accessory that may be used in conjunction with the apparatus 20: a door attachment 112 configured for allowing the user 32 to utilize the resistance of a resistance band 108 effectively secured beneath a closed door 114 or the like in performing abdominal exercises. In one embodiment, as shown in FIG. 15, the door attachment 112 comprises an essentially U-shaped portion 116 configured for slidably engaging a bottom edge 118 of the door 114, and an attachment point 104 integral with the U-shaped portion 116, similar to the attachment point 104 described above. As shown in FIG. 16, the door attachment 112 may then be engaged with a pair of resistance band attachments. With the door attachment 112 and resistance band 108 so engaged, the user 32 may perform abdominal exercises similar to those described above, and shown in FIG. 16, with the added resistance of the closed door 114, thereby allowing the user 32 to further strengthen their abdominal muscles 64. In an alternate embodiment, shown in FIG. 17, at least one resistance band 108 may be looped around the handle portion 30, and both ends 106 of the resistance band 108 engaged with the attachment point 104, in order to provide resistance similar to the embodiment of FIG. 16.

It should be noted that the various types of attachment accessories 80 herein disclosed are not intended to be an exhaustive list of accessories, but rather are merely intended to illustrate the numerous types of accessories that are possible, as well as the overall versatility of the present invention. Thus, not only is the present invention configured for providing adequate support for a user's back 62, neck 70 and head while the user 32 performs a wide range of abdominal exercises, but it is also configured to allow the user 32 to selectively add resistance to such abdominal exercises, as well as provide a means for performing a variety of other non-abdominal exercises through the use of the various attachment accessories 80.

To summarize, regarding the exemplary embodiments of the present invention as shown and described herein, it will be appreciated that a portable abdominal exercise mat apparatus is disclosed and configured for providing adequate support for a user's back, neck and head while the user performs a wide range of abdominal exercises. Because the principles of the invention may be practiced in a number of configurations beyond those shown and described, it is to be understood that the invention is not in any way limited by the exemplary embodiments, but is generally directed to a portable abdominal exercise mat and is able to take numerous forms to do so without departing from the spirit and scope of the invention. Furthermore, the various features of each of the above-described embodiments may be combined in any logical manner and are intended to be included within the scope of the present invention.

Therefore, while aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An abdominal exercise mat apparatus comprising:

an elongate flexible mat terminating proximally in a first end and distally in a second end, with a pair of opposing lateral edges extending therebetween, the mat sized and configured for allowing a user to lie face-up on a top surface of the mat, with the user's head in contact with the top surface proximal the first end and the user's feet in flat contact with the top surface proximal the second end, when the mat is positioned on a stable surface;

a relatively rigid elongate handle portion engaged with and extending laterally along at least a portion of the first end of the mat, the handle portion partially spaced apart from the first end, allowing the user to grasp the handle portion with at least one of the user's hands;

whereby, during use of the apparatus on a stable surface with the user lying face-up on the top surface of the mat, their head proximal the first end and their feet proximal the second end, the top surface conforms to, and remains in substantially continuous contact with, the user's back and head as the user grasps the handle portion above their head and pushes it upward while elevating their shoulder blades off the stable surface.

2. The abdominal exercise mat apparatus of claim 1, wherein the first end of the mat provides an at least one loop sized and configured for receiving the handle portion.

3. The abdominal exercise mat apparatus of claim 2, wherein the at least one loop is formed by folding a portion of the first end of the mat against itself.

4. The abdominal exercise mat apparatus of claim 3, wherein an at least one seam is formed on the top surface of the mat between the durable material and the mat, a portion of the at least one seam defining an arch configured to serve as a reference point for the user to know where to place their head on the mat during use.

5. The abdominal exercise mat apparatus of claim 2, wherein the at least one loop is made of a durable material.

6. The abdominal exercise mat apparatus of claim 2, wherein the first end of the mat provides a pair of laterally offset loops in which the handle portion is received at its respective opposite handle ends.

7. The abdominal exercise mat apparatus of claim 2, wherein the loops are positioned proximal the opposing lateral edges of the mat.

8. The abdominal exercise mat apparatus of claim 1, wherein the handle portion provides an at least one padded grip portion.

9. The abdominal exercise mat apparatus of claim 1, wherein the opposing lateral edges of the mat are tapered along at least a portion thereof.

10. The abdominal exercise mat apparatus of claim 1, wherein the length of the handle portion is at least as long as the distance between the opposing lateral edges of the mat at the first end.

11. The abdominal exercise mat apparatus of claim 1, further comprising a neck rest selectively positionable on the top surface of the mat and configured for remaining in substantially continuous contact with the user's neck during use of the apparatus.

12. The abdominal exercise mat apparatus of claim 11, wherein the neck rest is made of a soft, conforming material.

13. The abdominal exercise mat apparatus of claim 1, wherein the handle portion provides a pair of opposing, substantially tubular handle ends, each of the handle ends configured for removably accepting an attachment accessory therewithin.

14. The abdominal exercise mat apparatus of claim 13, wherein the attachment accessory is selected from the group consisting of: an integral weight attachment, a selective weight attachment, and a resistance band attachment.

15. The abdominal exercise mat apparatus of claim 1, further comprising a door attachment, the door attachment comprising:

a substantially U-shaped portion configured for selective engagement with a door;

an at least one resistance band attachment point integral with the U-shaped portion; and an at least one resistance band configured for selective engagement with the at least one resistance band attachment point, the at least one resistance band being further engagable with the handle portion.

16. An abdominal exercise mat apparatus consisting essentially of:

an elongate flexible mat terminating proximally in a first end and distally in a second end, with a pair of opposing lateral edges extending therebetween, the mat sized and configured for allowing a user to lie face-up on a top surface of the mat, with the user's head in contact with the top surface proximal the first end and the user's feet in flat contact with the top surface proximal the second end, when the mat is positioned on a stable surface; and the first end of the mat providing a pair of laterally offset loops configured for receiving a relatively rigid elongate handle portion partially spaced apart from the first end, allowing a user to grasp the handle portion with at least one of the user's hands;

whereby, during use of the apparatus on a stable surface with the user lying face-up on a top surface of the mat, their head proximal the first end and their feet proximal the second end, the top surface conforms to, and remains in substantially continuous contact with, the user's back and head as the user grasps the handle portion above their head and pushes it upward while elevating their shoulder blades off the stable surface.

17. An abdominal exercise mat apparatus comprising:

an elongate flexible mat terminating proximally in a first end and distally in a second end, with a pair of opposing lateral edges extending therebetween, the distance between the first and second ends being at least sixty eight inches, and the distance between the lateral edges being between twenty four and thirty inches at the mat's widest point; and a relatively rigid elongate handle portion engaged with and extending laterally along at least a portion of the first end of the mat, the handle portion partially spaced apart from the first end, allowing the user to grasp the handle portion with at least one of the user's hands;

whereby, during use of the apparatus on a stable surface with the user lying face-up on the top surface of the mat, their head proximal the first end and their feet proximal the second end, the top surface conforms to, and remains in substantially continuous contact with, the user's back and head as the user grasps the handle portion above their head and pushes it upward while elevating their shoulder blades off the stable surface.

* * * * *

UNITED STATES PATENT AND TRADEMARK OFFICE

CERTIFICATE OF CORRECTION

PATENT NO. : 8,075,464 B2
APPLICATION NO. : 12/696894
DATED : December 13, 2011
INVENTOR(S) : Christopher Blake Hayes et al.

It is certified that error appears in the above-identified patent and that said Letters Patent is hereby corrected as shown below:

Title Page, delete title page and substitute the attached title page therefor.

With respect to the drawing figure that has been published on the face of the above-identified patent document, said drawing figure, currently being Fig. 13, should be changed to Fig. 4.

Signed and Sealed this
Fifteenth Day of May, 2012

David J. Kappos

David J. Kappos
*Director of the United States Patent and Trademark Office*

(12) United States Patent
Hayes et al.

(10) Patent No.: US 8,075,464 B2
(45) Date of Patent: Dec. 13, 2011

(54) PORTABLE ABDOMINAL EXERCISE MAT

(75) Inventors: Christopher Blake Hayes, Laguna Hills, CA (US); Nick L. Payzant, Irvine, CA (US)

(73) Assignee: Christopher Blake Hayes, Laguna Hills, CA (US)

( * ) Notice: Subject to any disclaimer, the term of this patent is extended or adjusted under 35 U.S.C. 154(b) by 0 days.

(21) Appl. No.: 12/696,894

(22) Filed: Jan. 29, 2010

(65) Prior Publication Data

US 2010/0197471 A1 Aug. 5, 2010

Related U.S. Application Data

(60) Provisional application No. 61/148,511, filed on Jan. 30, 2009.

(51) Int. Cl.
*A63B 21/00* (2006.01)

(52) U.S. Cl. ..... 482/142; 482/140; 5/122; 5/123; 5/127

(58) Field of Classification Search ..... 482/142, 482/130, 140; 5/122, 123, 127
See application file for complete search history.

(56) References Cited

U.S. PATENT DOCUMENTS

| | | | | | |
|---|---|---|---|---|---|
| 873,652 | A | * | 12/1907 | Banks | 5/122 |
| 2,096,423 | A | * | 10/1937 | Burr | 5/122 |
| 5,009,417 | A | | 4/1991 | Sarkozi | |
| 5,577,987 | A | | 11/1996 | Brown | |
| 5,697,874 | A | | 12/1997 | Abelbeck | |
| D390,288 | S | | 2/1998 | Fingleson et al. | |
| 5,720,699 | A | * | 2/1998 | Musachio et al. | 482/122 |
| 5,853,356 | A | * | 12/1998 | David | 482/126 |
| 5,971,480 | A | * | 10/1999 | Maschke | 297/273 |
| D430,627 | S | | 9/2000 | Bergman | |
| 6,322,485 | B1 | | 11/2001 | Marrero | |
| 6,663,537 | B2 | | 12/2003 | McCoy | |
| 7,172,540 | B2 | | 2/2007 | Nguyen | |

* cited by examiner

*Primary Examiner* — Jerome W Donnelly

(74) *Attorney, Agent, or Firm* — Mind Law Firm; Justin G. Sanders; Jeromye V. Sartain

(57) ABSTRACT

A portable abdominal exercise mat apparatus is disclosed comprising, in one embodiment, an elongate, flexible mat having a relatively rigid elongate handle portion engaged at one end of the mat, the apparatus being sized and configured for providing adequate support for a user's back, neck and head while the user performs a wide range of abdominal exercises. In further embodiments, the handle portion is configured for removably accepting a variety of attachment accessories, some of which are designed to allow the user to selectively add resistance to their abdominal exercises. Other attachment accessories allow the user to perform various non-abdominal exercises using the apparatus. When the apparatus is not being used, it can be easily rolled up or laid flat for storage or transport with very little space or weight requirements.

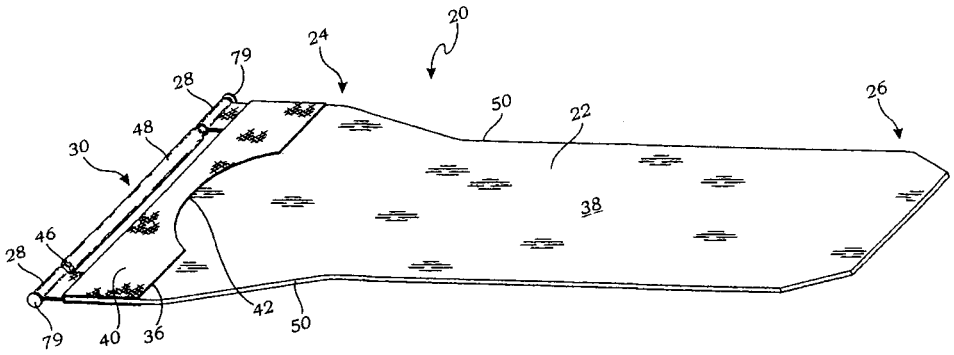

17 Claims, 9 Drawing Sheets